United States Patent [19]

Perkins, Jr.

[11] 4,359,182

[45] Nov. 16, 1982

[54] CARTON WITH REMOVABLE TOP

[75] Inventor: David Perkins, Jr., Cedar Rapids, Iowa

[73] Assignee: Corrugated Drum Systems, Inc., Des Moines, Iowa

[21] Appl. No.: 220,466

[22] Filed: Dec. 29, 1980

[51] Int. Cl.[3] ..... B65D 5/68

[52] U.S. Cl. ..... 229/45 R; 229/22; 229/41 C; 229/43

[58] Field of Search ..... 229/25, 18, 22, 41 C, 229/41 D, 5.5, 5.8, 45 R, 43

[56] References Cited

U.S. PATENT DOCUMENTS

| | | | |
|---|---|---|---|
| 903,381 | 11/1908 | Hutchinson . | |
| 1,947,190 | 2/1934 | Cody . | |
| 2,006,952 | 7/1935 | Klein . | |
| 2,142,101 | 1/1939 | Bachmeyer | 229/5.5 |
| 2,258,592 | 10/1941 | Bennett | 229/45 R |
| 2,733,852 | 2/1956 | Williamson . | |
| 3,116,007 | 12/1963 | D'Esposito et al. | 229/45 R |
| 3,144,189 | 8/1964 | Bartz . | |
| 3,204,849 | 9/1965 | Vinney . | |
| 3,692,231 | 9/1972 | Neitzke et al. | 229/45 R |
| 3,695,167 | 10/1972 | Schmidt et al. . | |
| 4,105,153 | 8/1978 | Locke . | |
| 4,134,531 | 1/1979 | Martinez et al. | 229/41 C |
| 4,166,567 | 9/1979 | Beach, Jr. et al. . | |
| 4,208,954 | 6/1980 | Chase | 229/43 R |

FOREIGN PATENT DOCUMENTS

| | | | |
|---|---|---|---|
| 242474 | 10/1946 | Switzerland | 229/45 R |

*Primary Examiner*—William Price
*Assistant Examiner*—Gary E. Elkins
*Attorney, Agent, or Firm*—Merchant, Gould, Smith, Edell, Welter & Schmidt

[57] ABSTRACT

A carton having a body (22) and a cover (26) removable therefrom, the body having an even number of panels (28) intersecting at an even number of vertices, and having a plurality of locking tabs (44) located at the tops of alternate vertices and folded outwardly to extend toward the bottom of the body, and the cover having a flat panel (30) with a like number of sides intersecting at a like number of vertices, and a plurality of cover tabs (76, 78, 80) located at said vertices and folding inwards to extend toward said panel.

5 Claims, 19 Drawing Figures

FIG. 1
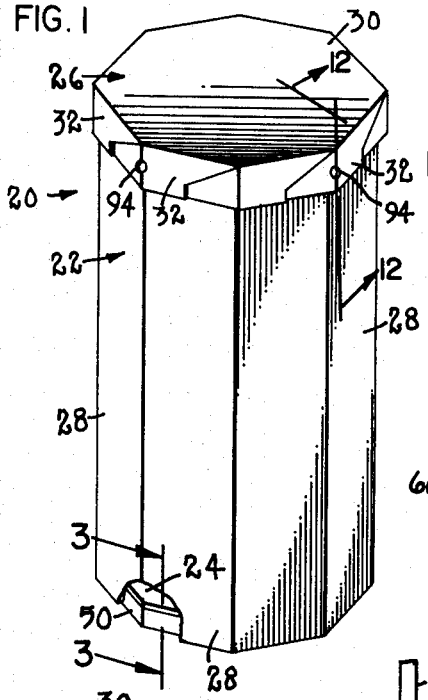
FIG. 6
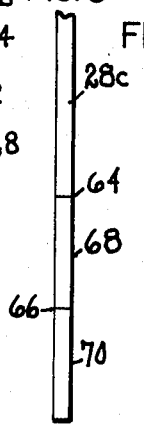
FIG. 7
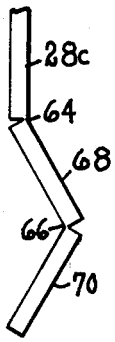
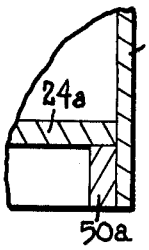
FIG. 4
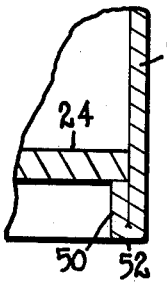
FIG. 3
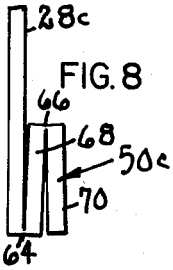
FIG. 8
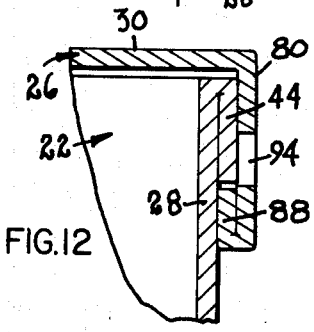
FIG.12
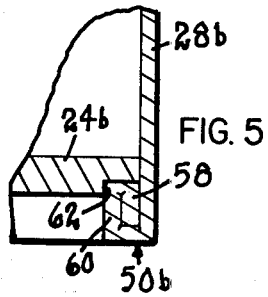
FIG. 5
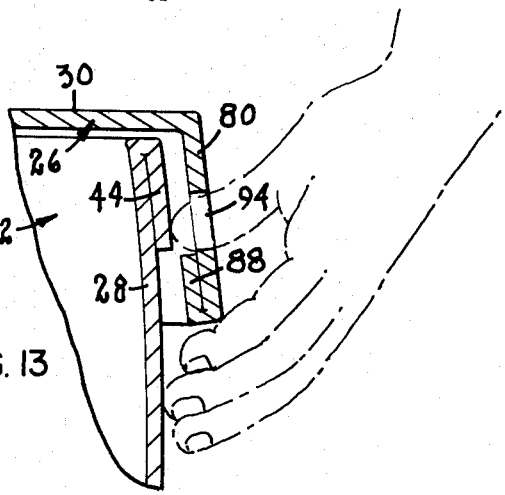
FIG. 13
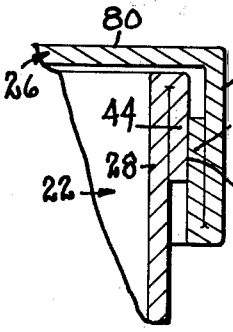
FIG. 14

FIG. 17
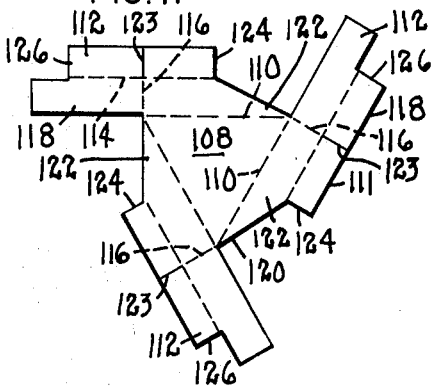
FIG. 18
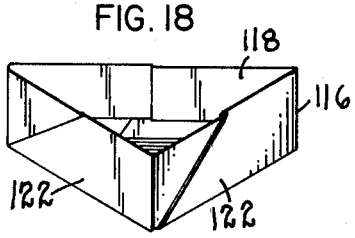
FIG. 19
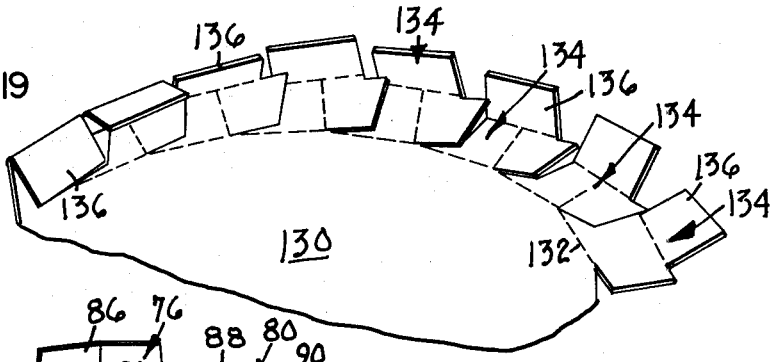
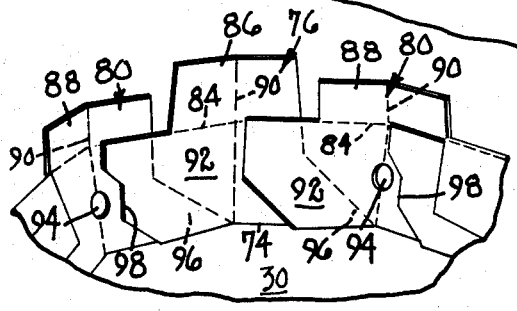
FIG. 10
FIG. 11
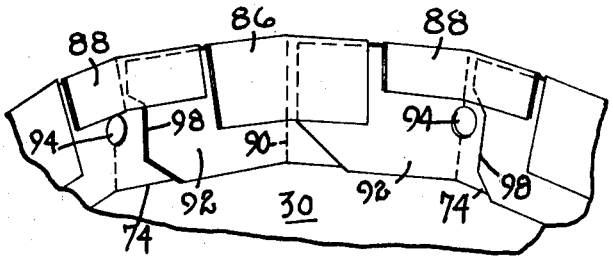

CARTON WITH REMOVABLE TOP

TECHNICAL FIELD

This invention relates to the field of packaging, and more particularly to collapsible containers made of material such as paperboard, which can be supplied flat and erected simply and rapidly at their destination, particularly containers of polygonal cross-section.

BACKGROUND OF THE INVENTION

Many kinds of goods are supplied by their makers in containers of paperboard or similar material. The containers are in turn obtained from manufacturers, and of course must be supplied empty. It is desirable that containers be so designed that they can be supplied in bulk by their manufacturers, and stored prior to use, in compact form.

BRIEF DESCRIPTION OF THE INVENTION

This invention comprises a container consisting of a body and a cover, each designed to be supplied by the manufacturer in substantially flat form for ready assembly at their destination. The body is of polygonal cross-section having a removable bottom panel which can be inserted to rest on support pads at the bottom of the body and retain the container in its expanded condition, as well as support the contents. The cover is formed from a blank comprising a central polygonal panel and a plurality of peripheral tabs which can be folded to surround the tops of the body panels, the latter having outwardly formed locking tabs. When the polygon is regular, the folded cover may be applied to the body in either of two orientations, one in which the cover is easily removable, and one in which removal of the cover is opposed and release is effected through thumbholes in selected tabs.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

BRIEF DESCRIPTION OF THE DRAWING

In the drawing, in which like reference numerals indicate corresponding parts throughout the several views, FIG. 1 is a view in perspective of an octagonal container and separable top according to the invention;

FIG. 3 is a fragmentary sectional view to a larger scale taken along the line 3—3 of FIG. 1;

FIGS. 4 and 5 are views similar to FIG. 3 showing modified bottom structures;

FIGS. 6, 7, and 8 shows steps in forming of a still further modified bottom structure;

FIGS. 10 and 11 show steps in the folding of a cover from the blank of FIG. 9;

FIGS. 12 and 13 are fragmentary sectional views taken along the line 12—12 of FIG. 1, to a larger scale;

FIG. 14 is a view similar to FIG. 10 showing a different relation between the cover and the body of the container;

FIGS. 17 and 18 are views showing how the invention may be applied to a container cover of triangular configuration; and FIG. 19 is a fragmentary view showing how the invention may be applied to a cover for a container having eighteen equal sides.

DESCRIPTION OF THE PREFERRED EMBODIMENT

Figure 9:
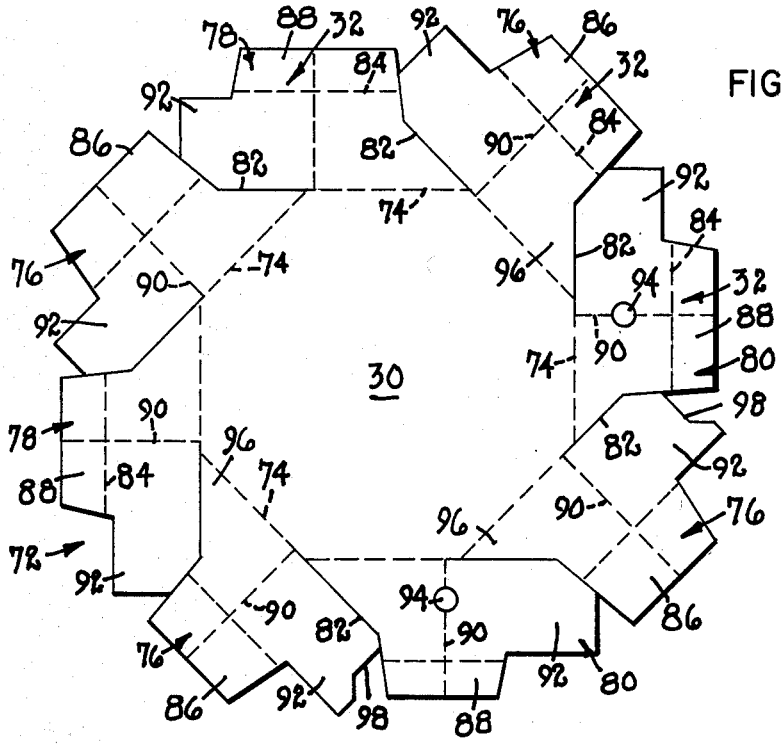
FIG. 9 shows the blank for forming the removable cover of the container shown in FIG. 1.

FIG. 1 shows the invention applied to a container 20 having a body 22 with a removable bottom panel 24 and a removable cover 26. The container is shown to have the transverse section of a regular octagon, although other configurations, preferably having even numbers of sides, may be used. Body 22 is made up of eight side panels 28. Cover 26 has an octagonal top panel 30 and a plurality of composite sides 32.

Figure 2:
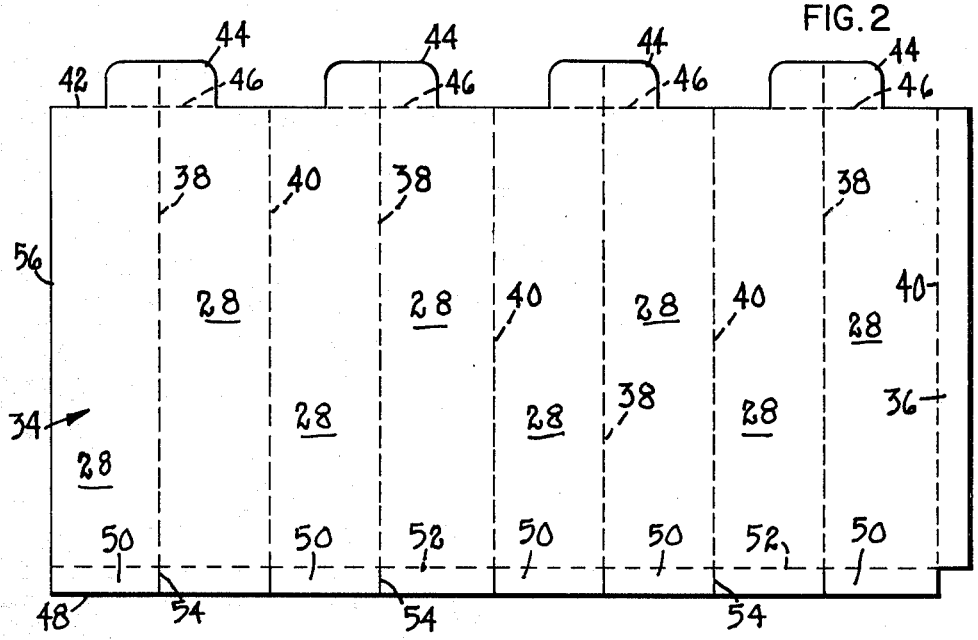
FIG. 2 shows a blank for forming the body of the container of FIG. 1.

FIG. 2 shows the blank 34 for body 22 to comprise side panels 28 and a closure flap 36, defined by alternate longitudinal fold lines 38, 40, also identified as vertice lines hereinafter. The blank is extended at the top 42 to define a plurality of identical locking tabs 44 centered on alternate body fold lines 38 and having a common fold line 46. At the bottom 48 of blank 34, a plurality of support tabs 50 are defined by a common fold line 52, and may be separated by cuts 54.

The container is formed by folding tabs 50 inwardly and securing them to panels 28 by cement, staples, or other suitable means, then folding the blank along fold lines 38, 40, and securing flap 36 to the edge 56 of the panel 28 at the other side of the blank. A separate octagonal bottom panel 24 of suitable size is then inserted into the body to rest on upturned tabs 50 and give the container its desired octagonal shape. As shown in FIG. 3, panel 24 may be of greater thickness than the panels 28 of the body if this is desired.

The bottom structure of the container may be modified as suggested in the drawing. FIG. 4 shows that bottom panel **24*a* may rest on support tabs 50*a*, which are separate from panels 28*a* and secured thereto by suitable cement or staples. Tabs 50*a*** may be continuous around the inside of the body, or may comprise separate pieces secured to the several panels of the body.

FIG. 5 shows that when additional support for bottom panel **24*b* is desired, the body panels 28*b* may be given a double fold in the inward direction, to form tabs 50*b* of double thickness 58, 60. FIG. 5 also shows that a bottom panel 24*b* may be of sufficient thickness to provide a peripheral groove 62 for maintaining tabs 50*b*** in folded condition: this may under some conditions obviate the need for stapling or cementing the tabs.

FIGS. 6–8 show that a body panel **28*c* may be doubly folded at its bottom in opposite directions, at 64 and 66, to give a support tab 50*c* of two plies 68 and 70**.

Attention is now directed to FIG. 9, which shows a blank 72 for forming the cover 26 of the octagonal container. The blank comprises the central octagonal top panel 30 of suitable dimensions, separated by fold lines 74 from cover tabs 76, 78, 80 of generally similar outline, mutually separated by angular cuts 82. All the tabs have fold lines 84 parallel to the sides of the octagon and equally spaced therefrom. Tabs 76 extend beyond the fold lines 84 further than do tabs 78 and 80, so that there are provided flaps 86, 88 of different widths.

All the tabs are provided with further fold lines 90, also identified as vertice lines hereinafter, perpendicular to the sides of the octagon at sites slightly spaced from the vertices of the octagon, and the tabs extend beyond lines 90 as wings 92. Thumbholes 94 are formed in an adjacent pair of tabs 80 spaced by a tab 76. Cuts 82 are configured so that each tab has a generally triangular portion 96 to cooperate with the wing 92 of the adjacent tab when the cover is folded, as will now be explained referring also to FIGS. 10 and 11.

Cover 26 is assembled by folding tabs 76, 78, 80 in the same direction along fold lines 74 so that each wing 92 is inside of the adjacent triangular space 96, as shown in FIG. 10. Then flaps 86, 88 are folded in the same direction, to overlie wings 92 and hold them in place, as shown in FIG. 11. If desired portions of flaps 92 may be cut away as at 98, to prevent interference with thumbholes 94.

Cover 26 can be placed on body 22 in two different orientations. In a first orientation the fold lines 90 of tabs 76 are aligned with fold lines 40 of body 22. As shown in FIG. 14, this means that tabs 42 engage flaps 86 face to face, as at 100 in FIG. 14, and the cover can be placed on and removed from the body without difficulty.

In a second orientation cover 26 is placed on body 22 so that the fold lines 90 of tabs 76 are aligned with fold lines 38 of body 22. As shown in FIG. 12, this means that tabs 44 engage flaps 88 edgewise, so that when once emplaced cover 26 is held in position and cannot be accidentally displaced.

To remove the cover, tabs 44 and panels 28 are displaced inwardly by thumb pressure through holes 94, and flaps 88 are pulled outwardly by finger action, until the edgewise engagement between the flaps and the tab is released, as shown in FIG. 13. If this is done at two adjacent flaps 88, the natural resilience of the cover permits its removal from the body.

Figure 15:
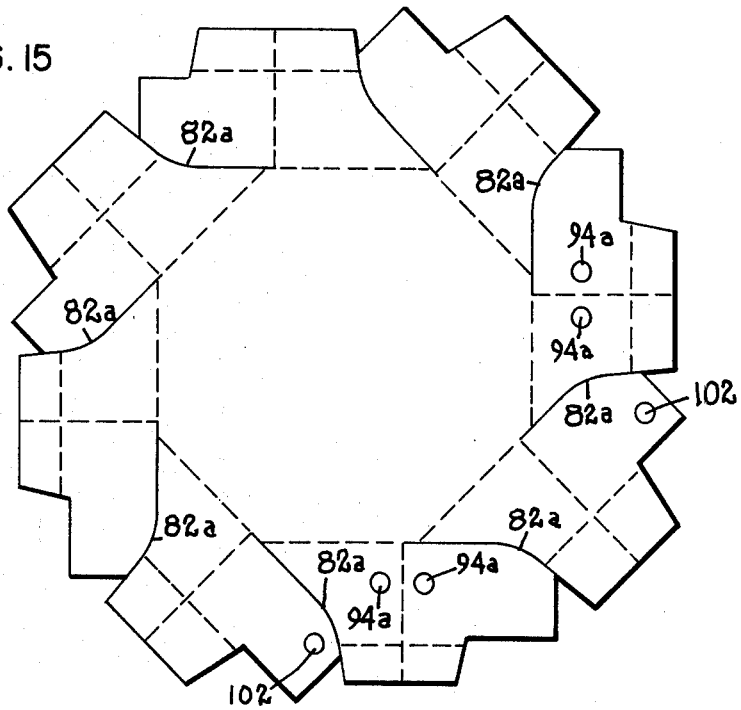
FIG. 15 is a view like FIG. 9 showing a modified cover structure.

FIG. 15 shows a modified cover blank. Here cuts **82*a* are not angular, as in FIG. 9, but are smoothly curved. Also thumbholes 102 are provided instead of the cutouts 92 of FIG. 9, and a pair of thumbholes 94*a* replace each thumbhole 94**.

Figure 16:
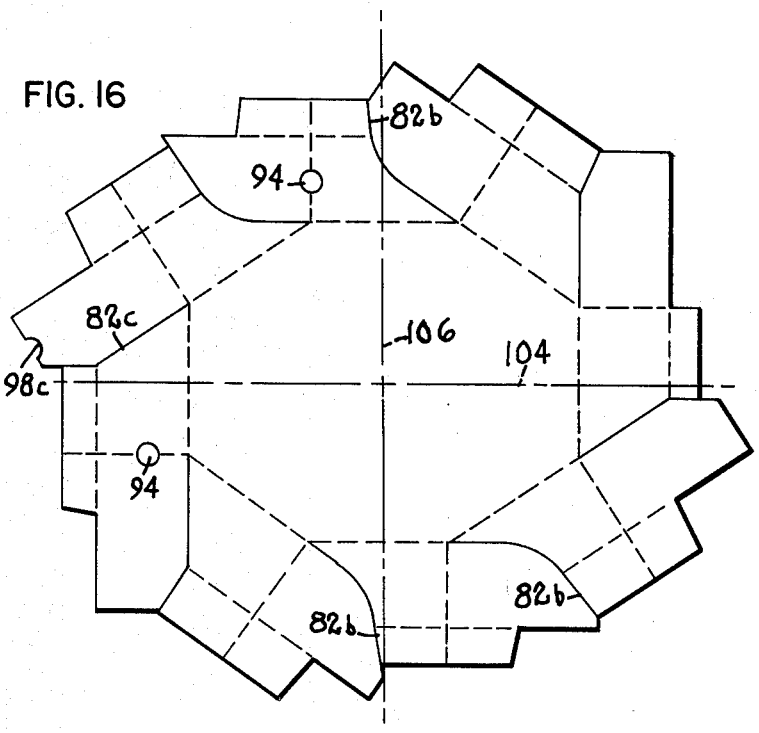
FIG. 16 is a view like FIG. 9 showing how the invention may be applied to a cover for a container in which the transverse axes are not equal.

FIG. 16 shows a modified cover blank in which panel 30 is not a regular octagon, being longer along a first axis 104 than along a second axis 106, although it is bilaterally symmertrical about both axes. Alternative structures are also shown to prevent interference with thumbholes 94. Curved cut **82*b* is shaped to avoid the interference, and angular cut 82*c* is provided with a suitable semi-circular cutout 98*c*** for the same purpose. It will be realized that when the configuration of the body and the cover is not that of a regular polygon, alternaive positioning of the cover on the body is no longer available.

The inventive principle involved is not limited to containers of octagonal cross-section, whether or not they are regular. It is convenient to give the bodies an even number of sides, as that facilitates collapsing the bodies into sets of opposite panels that lie against each other so that the bodies are folded flat and can be stacked or bundled for storage and shipment prior to use. Bottom panels of appropriate sizes and shapes may be inserted in the individual collapsed container bodies, or can be stacked and delivered or stored separately.

FIGS. 17 and 18 show the invention applied to a cover for use with a body of triangular section. It includes a triangular top panel 108 separated by fold lines 110 from three identical tabs 112 having first fold lines 114 parallel to lines 110, second fold lines 116 perpendicular thereto at the vertices of the triangle, and flaps 118 extending beyond lines 110 and provided with angular cuts 120 to define triangular portions 122. If the container being constructed is of relatively small cross-sectional area, folding of the cover into the form shown in FIG. 18 may be facilitated if the outer portions 123 of lines 116 are cuts rather than folds. Tabs 112 extend beyond lines 116 to such an extent that when the top is folded into form ends 124 and 126 at adjacent tabs 112 come into substantial abutment.

FIG. 19 is presented to show fragmentarily that the invention can be applied to the cover and body of a container having, for example, 18 sides rather than eight sides, where an approximation to a circular cross-section is found desirable. Polygonal top panel 130 is separated by eighteen fold lines 132 from eighteen tabs 134 having flaps 136. As the number of sides of the polygon increases, the desirability of fixing the tabs and flaps after folding, by suitable cement or staples, becomes increasingly evident.

What is claimed is:

1. A carton having a body and a cover removable therefrom, said body having a number of panels intersecting at vertice lines and having a plurality of locking tabs located at the tops of at least two of said vertice lines, said vertice lines extending through said locking tabs, said locking tabs being folded outwardly to extend towards the bottom of the body, said panels and said locking tabs being formed in an integral first blank, and said cover having a flat panel with a like number of sides intersecting at a like number of vertice lines and a plurality of cover tabs located at said vertice lines, said vertice lines extending through said cover tabs, said cover tabs being folded inwards to extend toward said panel, said flat panel and said cover tabs being formed in an integral second blank.

2. A carton having a body and a cover removable therefrom, said body having an even number of panels intersecting at an even number of vertice lines, and having a plurality of locking tabs located at the tops of alternate vertice lines and folded outwardly to extend towards the bottom of the body, and said cover having a flat panel with a like number of sides intersecting at a like number of vertice lines and a plurality of cover tabs located at said, vertice lines and folded inwards to extend toward said panel, said cover tabs being alternately larger or smaller, to overlie said locking tabs in a first rotated position of the cover on the body so as to enable removal of the cover, and to engage the locking tabs endwise in a second rotated position of the cover on the body to oppose removal of the cover from the body.

3. A carton cover blank comprising a central panel and a plurality of peripheral tabs connected to said panel along first fold lines defining the sides of a polygon, the tabs having second fold lines parallel to the sides of the polygon to define outer flaps, and third fold lines perpendicular to said sides near the vertices of the polygon, the tabs being mutually separated, by cuts comprising in part extensions of the sides of the polygon in the same direction, to provide wings and lips which abut one another when the tabs are folded inward along the first and third fold lines, and which are retained when the flaps are folded inward along the second fold lines.

4. A carton cover according to claim 3 in which said flaps are alternately of greater and lesser widths along said third fold line.

5. A carton comprising:

a body having side panels intersecting at vertice lines, said side panels having lower support tabs;

a bottom panel resting on said support tabs, said bottom panel having means including a groove along said bottom panel acting both outwardly and downwardly on said support tabs; and a cover having a flat panel with a like number of sides intersecting at a like number of vertice lines.

* * * * *